US012491975B1

(12) United States Patent
Lehr et al.

(10) Patent No.: US 12,491,975 B1
(45) Date of Patent: Dec. 9, 2025

(54) SHIPBOARD GIMBAL TRUNNION

(71) Applicants: Matthew D. Lehr, King George, VA (US); Timothy Li Ming Peng, Fredericksburg, VA (US); Aaron C. Williams, Yorktown, VA (US); Michael O. Koehler, Doswell, VA (US); Jonathan U. Crook, King George, VA (US)

(72) Inventors: Matthew D. Lehr, King George, VA (US); Timothy Li Ming Peng, Fredericksburg, VA (US); Aaron C. Williams, Yorktown, VA (US); Michael O. Koehler, Doswell, VA (US); Jonathan U. Crook, King George, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 494 days.

(21) Appl. No.: 18/074,582

(22) Filed: Dec. 5, 2022

(51) Int. Cl.
*B63G 1/00* (2006.01)
*F41H 13/00* (2006.01)

(52) U.S. Cl.
CPC ..... *B63G 1/00* (2013.01); *F41H 13/005* (2013.01)

(58) Field of Classification Search
None
See application file for complete search history.

(56) References Cited

U.S. PATENT DOCUMENTS

| | | | | |
|---|---|---|---|---|
| 8,322,269 | B2 * | 12/2012 | Sullivan | F41A 27/14 89/41.11 |
| 9,074,847 | B1 * | 7/2015 | Sullivan | F41G 5/16 |
| 10,788,284 | B1 * | 9/2020 | Kathe | F41F 1/06 |
| 2004/0050240 | A1 * | 3/2004 | Greene | F41A 23/24 89/41.06 |
| 2008/0034954 | A1 * | 2/2008 | Grober | F41G 5/14 89/41.02 |

(Continued)

*Primary Examiner* — Steven M Marsh
(74) *Attorney, Agent, or Firm* — Gerhard W. Thielman

(57) ABSTRACT

A shipboard platform is provided for azimuth and elevation pivoting of a targeting payload. The platform is coupled to a ship and includes a pedestal, an azimuth drive trunnion, a yoke having first and second struts, an elevation drive trunnion and an elevation support trunnion. The pedestal is disposed on the ship. The azimuth drive trunnion is disposed in the pedestal. The yoke is rotatably disposed on the azimuth drive trunnion. The elevation drive and support trunnions are rotatably disposed in their respective first and second struts. The payload is mountable to the elevation drive and support trunnions. Further, a gimbal trunnion is provided for pivoting a payload along an axis. The trunnion includes an annular shaft, an interface mounting plate, an annular rotor, an annular stator, and inner and outer annular housings. The shaft turns the payload along the axis. The interface mounting plate is axially disposed between the payload and the shaft. The annular rotor extends radially outward from the shaft for turning the mounting plate. The annular stator extends radially outward from the rotor to laterally constrain the rotor. The inner and outer annular housings extending radially outward from the stator for encasing the axially tandem bearings.

7 Claims, 12 Drawing Sheets

(56) References Cited

U.S. PATENT DOCUMENTS

| | | | | |
|---|---|---|---|---|
| 2008/0048033 | A1* | 2/2008 | Quinn | F41G 3/16 89/41.17 |
| 2017/0115086 | A1* | 4/2017 | Lung | F41A 27/18 |
| 2024/0118059 | A1* | 4/2024 | Allison | F41H 13/005 |

* cited by examiner

SHIPBOARD GIMBAL TRUNNION

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to gimbals for weapon systems. In particular, the invention applies to a gimbal assembly for turning along axes to aim a laser tracking system at a target in azimuth and elevation angles.

Naval combat vessels include weapon systems that turn laterally with respect to the ship's orientation, as well as in elevation from the horizon. Such systems employ gimbals that rotate in orthogonal axes to enable the weapon to be pointed at a target irrespective of its relative position to the ship.

SUMMARY

Conventional gimbal trunnions yield disadvantages addressed by various exemplary embodiments of the present invention. In particular, various exemplary embodiments provide a trunnion for turning a payload about an axis. The trunnion includes bearings, housings and shafts. An azimuth drive assembly turns a gimbal on a pedestal. Elevation trunnions turn the payload in the gimbal. Exemplary embodiments provide a gimbal trunnion for pivoting a payload along an axis. The trunnion includes an annular shaft, an interface mounting plate, an annular rotor, an annular stator, and inner and outer annular housings.

The shaft turns the payload along the axis. The interface mounting plate is axially disposed between the payload and the shaft. The annular rotor extends radially outward from the shaft for turning the mounting plate. The annular stator extends radially outward from the rotor to laterally constrain the rotor. The inner and outer annular housings extending radially outward from the stator for encasing the axially tandem bearings.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Exemplary embodiments provide an improved gimbal system for directed energy (DE) systems, optimized for shipboard use. The purpose of the embodiments is to enable a naval vessel to direct laser energy at a target to disrupt its operation. The embodiments have special adaptations to satisfy the requirements of installation on a warship. The improved gimbal system is modular and suited to multiple shipboard DE applications. The disclosure generally employs quantity units with the following abbreviations: length in meters (m) and mass in kilograms (kg).

Exemplary embodiments were created to fulfill a need for a gimbaled laser system suited for shipboard operation. Previous endeavors have relied upon gimbal systems intended for terrestrial use. These conventional systems, while expedient to acquire, did not satisfy warship requirements for radar cross-section, green-water loading, and electromagnetic environment.

Additionally, large, fully enclosed spaces within the gimbal system to house equipment are desired for protection from the maritime environment. Provisions for the internal routing of a Coude path are also desired. Some DE projects have a requirement to maintain track of targets passing directly over the ship, which presents additional challenges.

Figure 1:
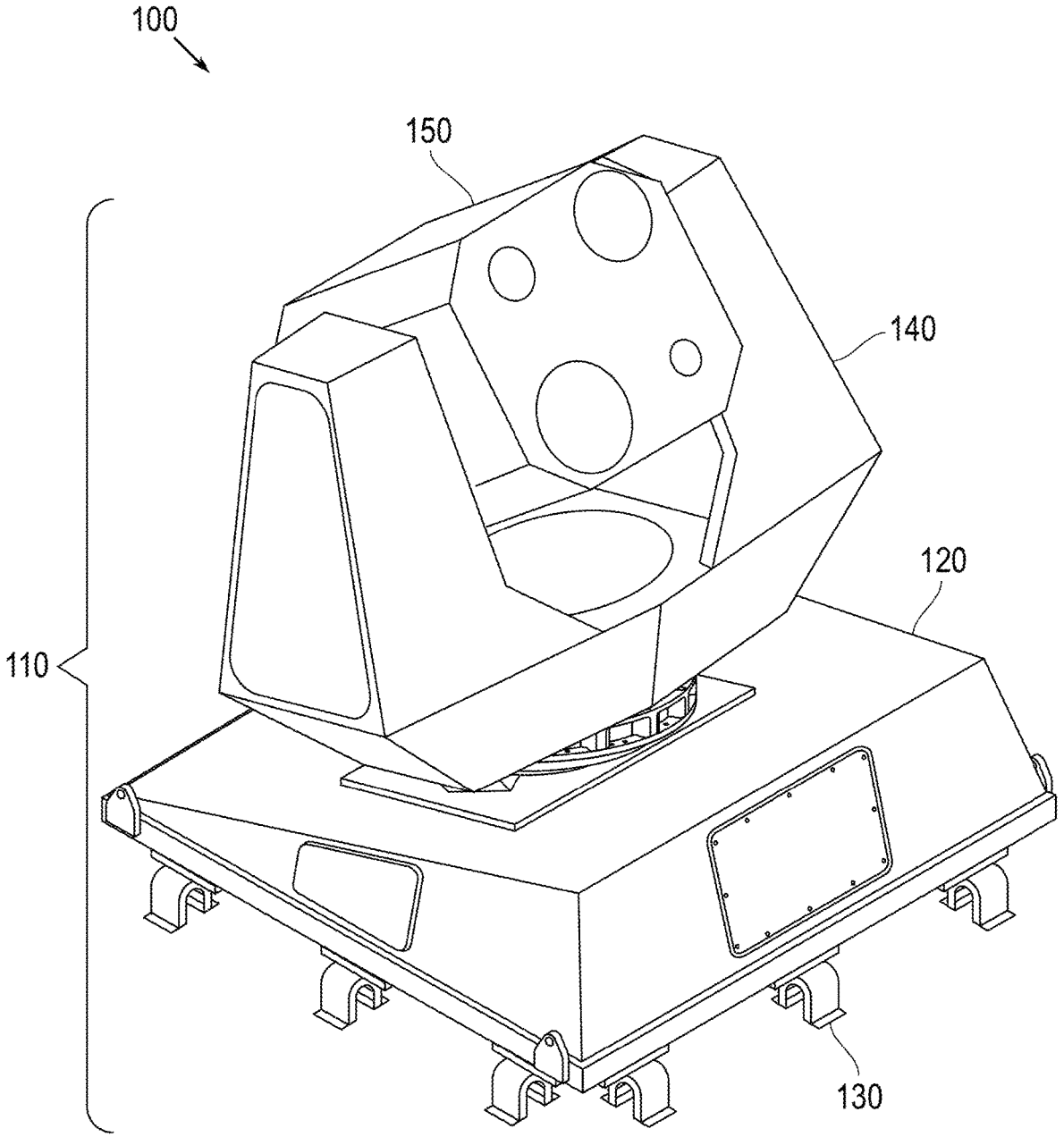
FIG. 1 is an isometric view of a gimbal system.

FIG. 1 shows an isometric view 100 of a targeting platform 110. A pedestal 120 mounted to a combat vessel by shock isolators 130 supports a yoke 140, which includes a pair of struts extending from a base and turns on the pedestal 120. A payload 150 pivotably attaches to the yoke 140 between the struts. The payload 150 includes tracking equipment with which to engage a target. The yoke 140 is has an isogrid honeycomb structure constructed from aluminum to reduce inertial mass. The pedestal 120 is canted at an oblique angle in relation to the combat vessel. This geometry enables the payload 150 to be rotated to angles that extend beyond overhead for continued tracking and/or engaging of targets.

Figure 2:
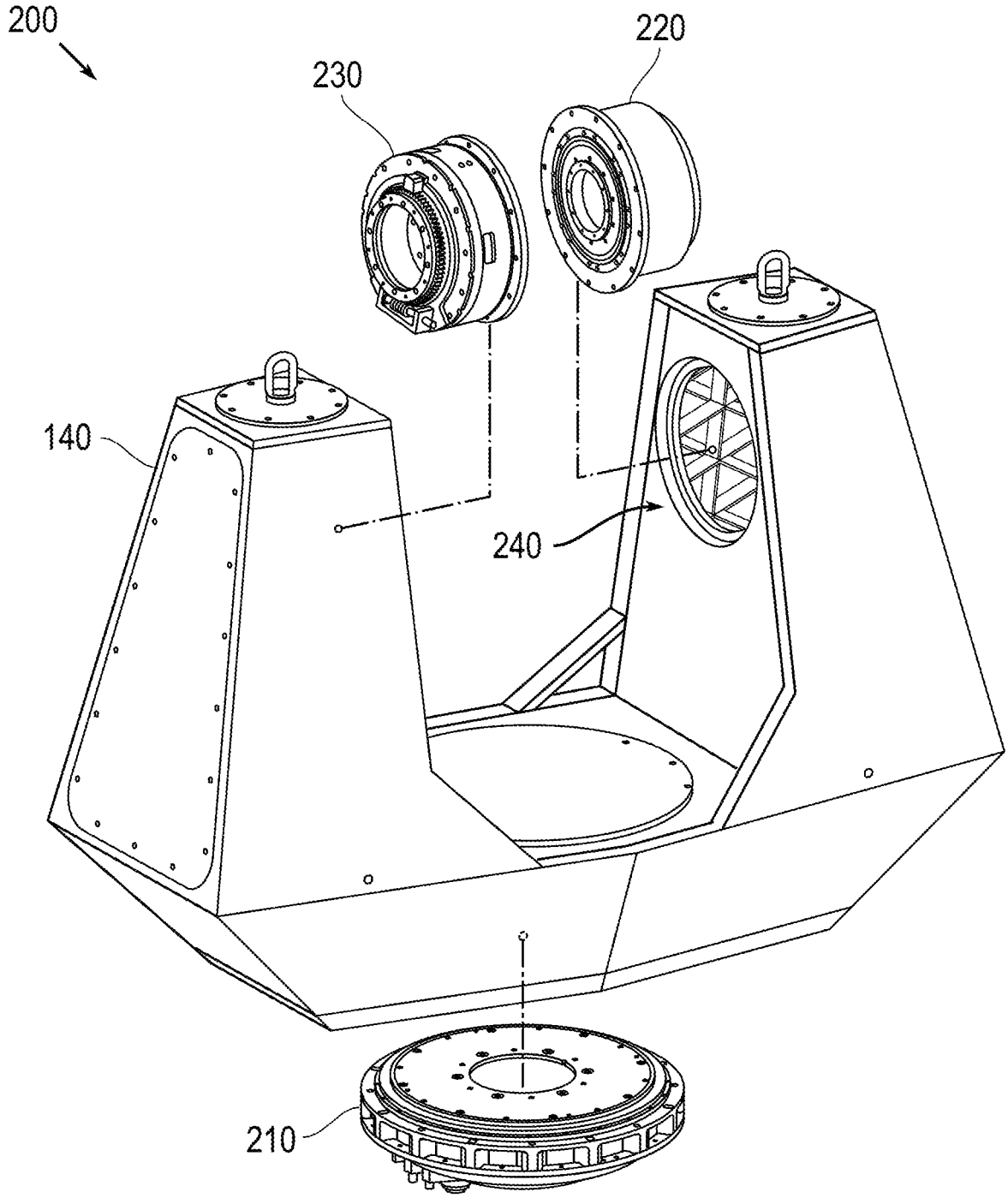
FIG. 2 is an isometric view of a yoke for the gimbal system.

FIG. 2 shows an isometric exploded view 200 of exemplary gimbal components for the targeting platform 110. The components include an azimuth drive assembly 210, an elevation drive trunnion 220 and an elevation support trunnion 230. The azimuth drive assembly 210 enables the yoke 140 to rotate on the vertical axis on the pedestal 120. The elevation trunnions 220 and 230 mount into corresponding cavities 240 in the yoke 140 and enable the payload 150 to pivot on a lateral axis between arms of the yoke 140.

For an exemplary yoke 140 of 360 kg with height of 1.5 m and arm separation of 1.0 m aboard a combat vessel, the trunnions 210, 220 and 230 have respective diameters of 0.7 m, 0.4 m and 0.4 m and respective masses of 240 kg, 100 kg and 70 kg, being substantially composed of stainless steel.

Figure 3A:
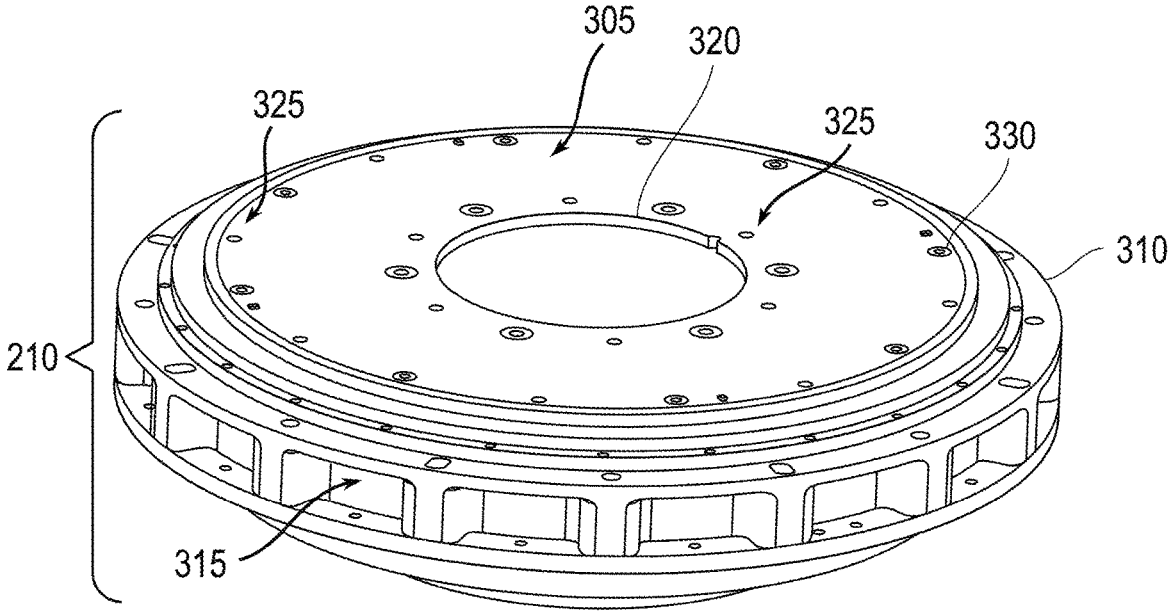
FIGS. 3A, 3B and 3C are isometric views of an azimuth drive assembly.
Figure 3B:
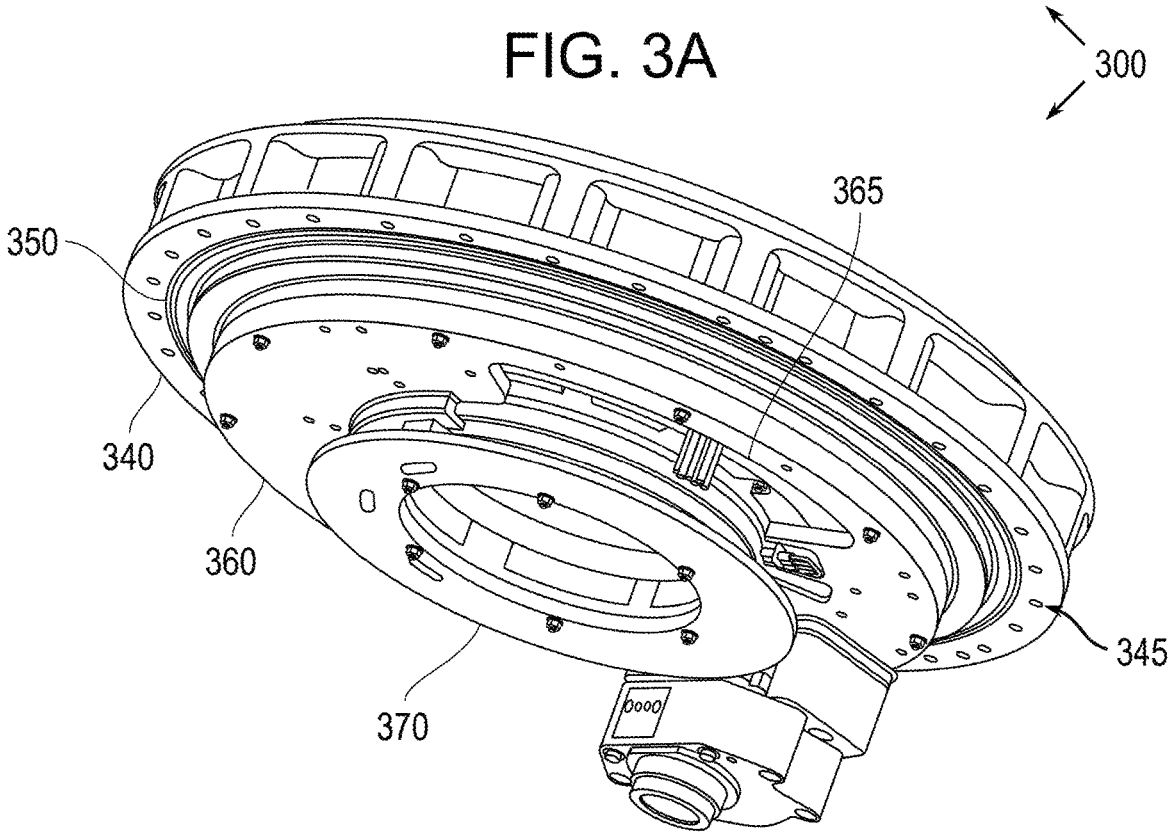
Figure 3C:
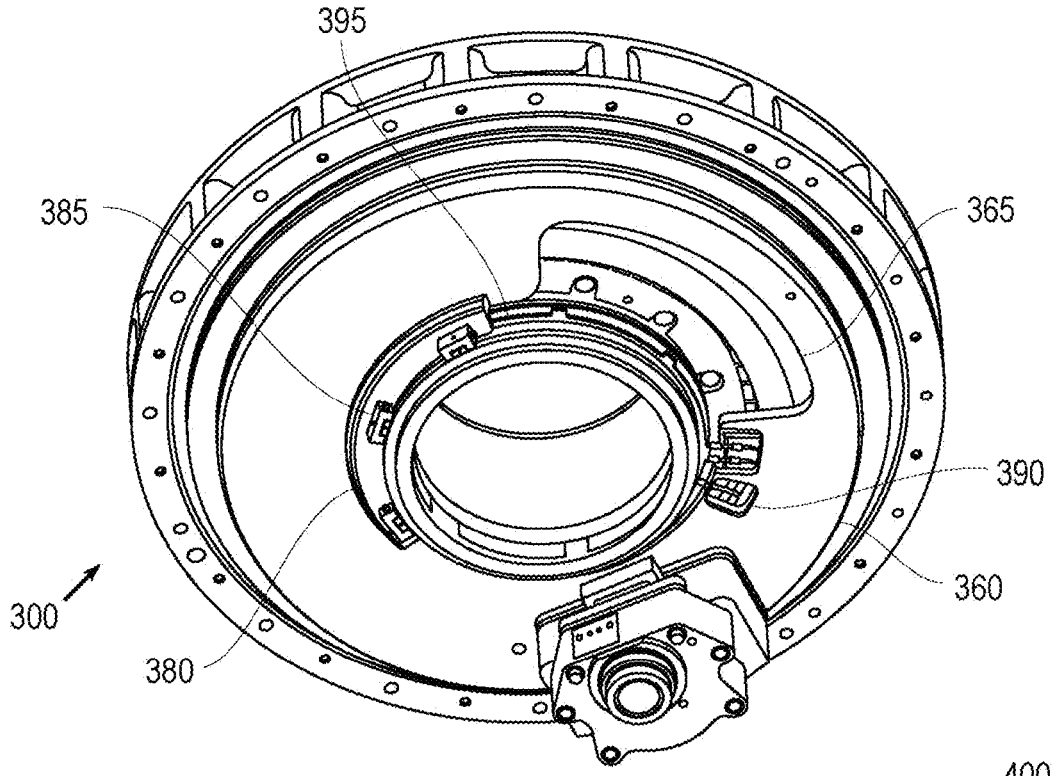

FIGS. 3A, 3B and 3C show isometric assembly views 300 of the azimuth drive assembly 210, which engages the yoke 140 along an upper interface surface 305. FIG. 3A illustrates the upper side of the assembly 210. An outer bearing housing 310 incorporates cutout pockets 315 to reduce weight, and defines the radial extent of the assembly 210. A center hole 320 in the surface 305 and surrounded by alignment holes 325 enables yoke attachment. An upper annular static seal 330 envelopes alignment holes 335. Together with the holes 325 and 335, the seal 330 provides a stiff and watertight seal for attachment interface of the yoke 140.

FIGS. 3B and 3C illustrate the lower side of the azimuth drive assembly 210. A stator mounting plate 340 attaches to the outer bearing housing 310 by circumferentially disposed bolts 345. A lower annular static seal 350 is disposed under the stator mounting plate 340 to provide a watertight seal for the attachment interface of the pedestal 120.

An encoder mounting plate 360 bolts onto the underside of the stator mounting plate 340, and includes an arc segment cutout 365 for electrical connections to the pedestal 120. A brake rotor 370 is disposed behind the encoder mounting plate 360. FIG. 3C shows the assembly 210 without the brake rotor 370. An arc segment 380 includes three encoder sensors 385 attached thereon. An inductive proximity sensor 390 is disposed on the encoder mounting plate 360 to provide indication of over-travel by detecting each end of a cam profile on a cam ring 395.

Figure 4A:
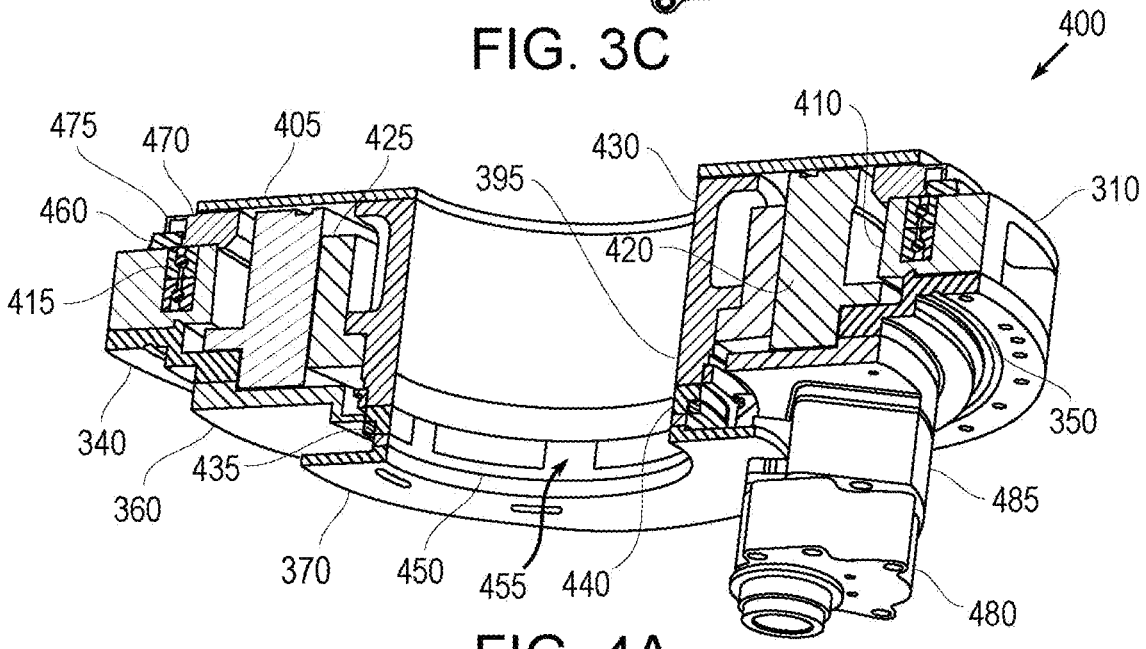
FIGS. 4A and 4B are respective sectional isometric and cross-section elevation views of the azimuth drive assembly.
Figure 4B:
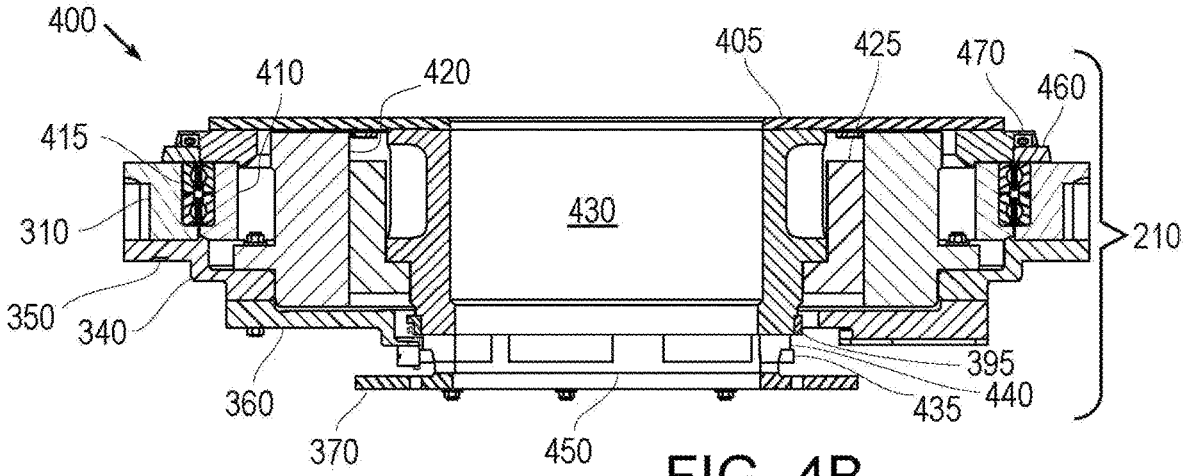
Figure 5:
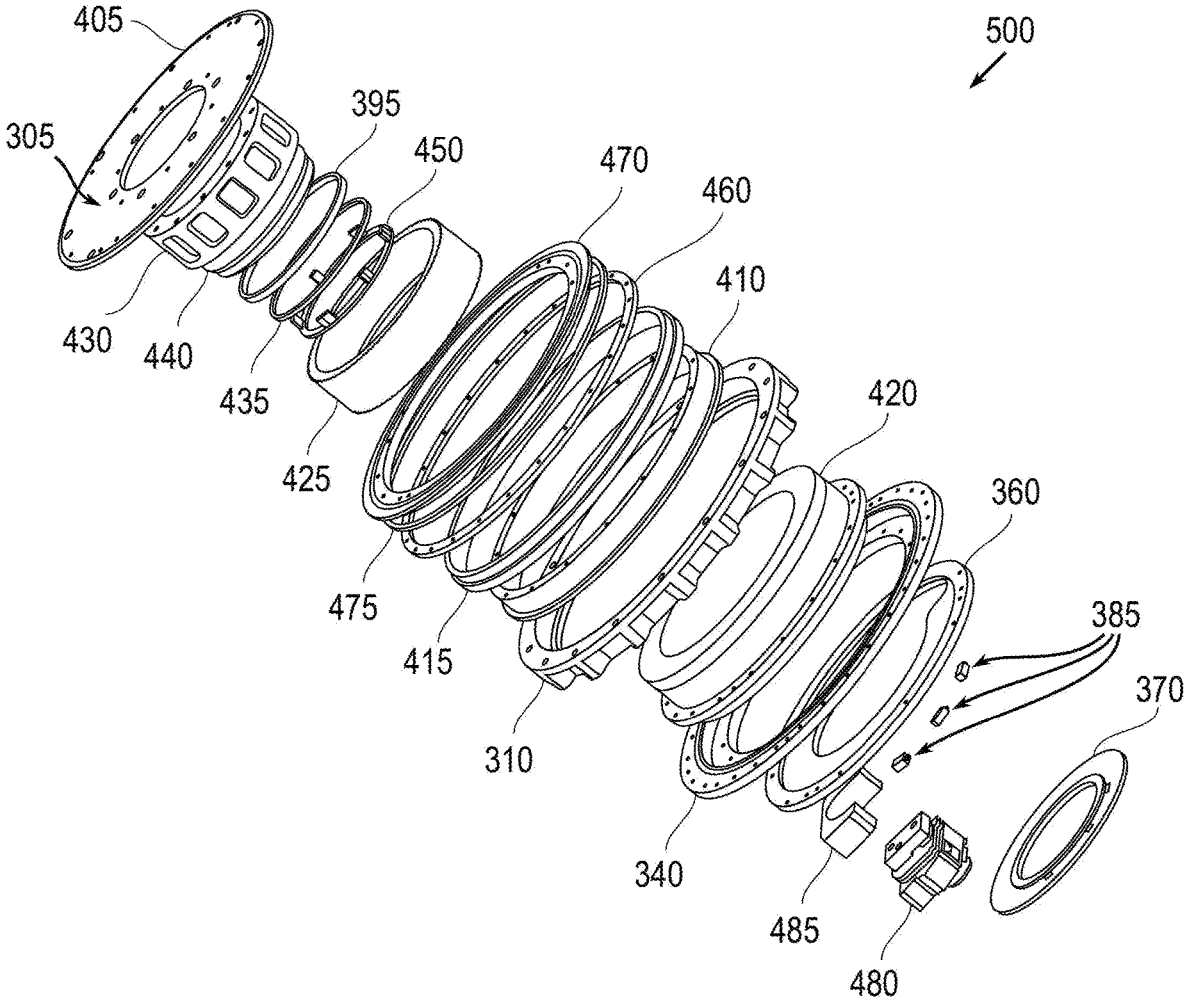
FIG. 5 is an isometric exploded view of the azimuth drive assembly.

FIGS. 4A and 4B respectively illustrate isometric sectional and elevation cross-section views 400 of the azimuth drive assembly 210 (shown in FIG. 5 in an exploded isometric view). A joiner plate 405 provides the upper interface surface 305. An inner bearing housing 410 abuts against the outer bearing housing 310 with a duplex bearing pair 415 disposed therebetween. The views 400 show a pair of bearings 415, although this plurality example is not limiting. A servo motor stator 420 attaches to the stator mounting plate 340, being disposed radially inward of the housing 410. A servo motor rotor 425 adjacently rotates radially inward of the stator 420.

An annular azimuth shaft 430 is bounded inwardly by the center hole 320. The motor rotor 425 attaches to the shaft 430 with mounting bolts. An encoder ring 435 and an annular encoder ring mount 440 are disposed below the azimuth shaft 430. A brake rotor standoff 450 separates the brake rotor 370 from the shaft 430. The standoff 450 is disposed below the shaft 430 and has raised bosses 455 that fit within angular pockets in the annular encoding ring mount 440. The rotor 425, shaft 430, rings 435 and 440, standoff 450 and brake rotor 370 comprise an azimuth rotation assembly. The encoder sensors 385 measure the shaft rotation angle by optically sensing markings on the outer surface of the encoder ring 435.

An outer bearing cap 460 secures the bearings 415 within the outer bearing housing 310. An inner bearing cap 470 secures the bearings 415 to the inner bearing housing 410. An annular dynamic seal 475, housed within the inner bearing cap 470 and facing the outer bearing cap 460, facilitates sealing to the yoke 140 through the joiner plate 405, which bridges both sets of rotating components.

The annular encoder ring mount 440 can be mechanically separate from annular azimuth shaft 430, which enables course runout adjustment of the encoder ring 435. A brake caliper 480 attaches to the annular encoder ring mount 440 via the caliper mount 485. The caliper 480 engages the brake rotor 370 to stop the rotating portion of assembly 210.

FIG. 5 illustrates an isometric exploded view 500 of components for the azimuth drive assembly 210, Shown from left-to-right, the items include the joiner plate 405 that provides surface 305, annular shaft 430 with annular encoder ring mount 440, cam ring 395, encoder ring 435, standoff 450, rotor 425 (that envelopes the shaft 430). Outward from and behind these are the bearing cap 470, dynamic seal 475, outer bearing cap 460, bearings 415, inner bearing housing 410, outer bearing housing 310 (with the bearings 415 disposed between the housings 310 and 410), stator 420, stator mounting plate 340, and encoder mounting plate 360. Encoder sensors 385 and the caliper mount 485 attach to the underside of encoder mounting plate 360. The brake caliper 480 is mounted to underside of caliper mount 485 and interfaces with the brake rotor 370.

Figure 6A:
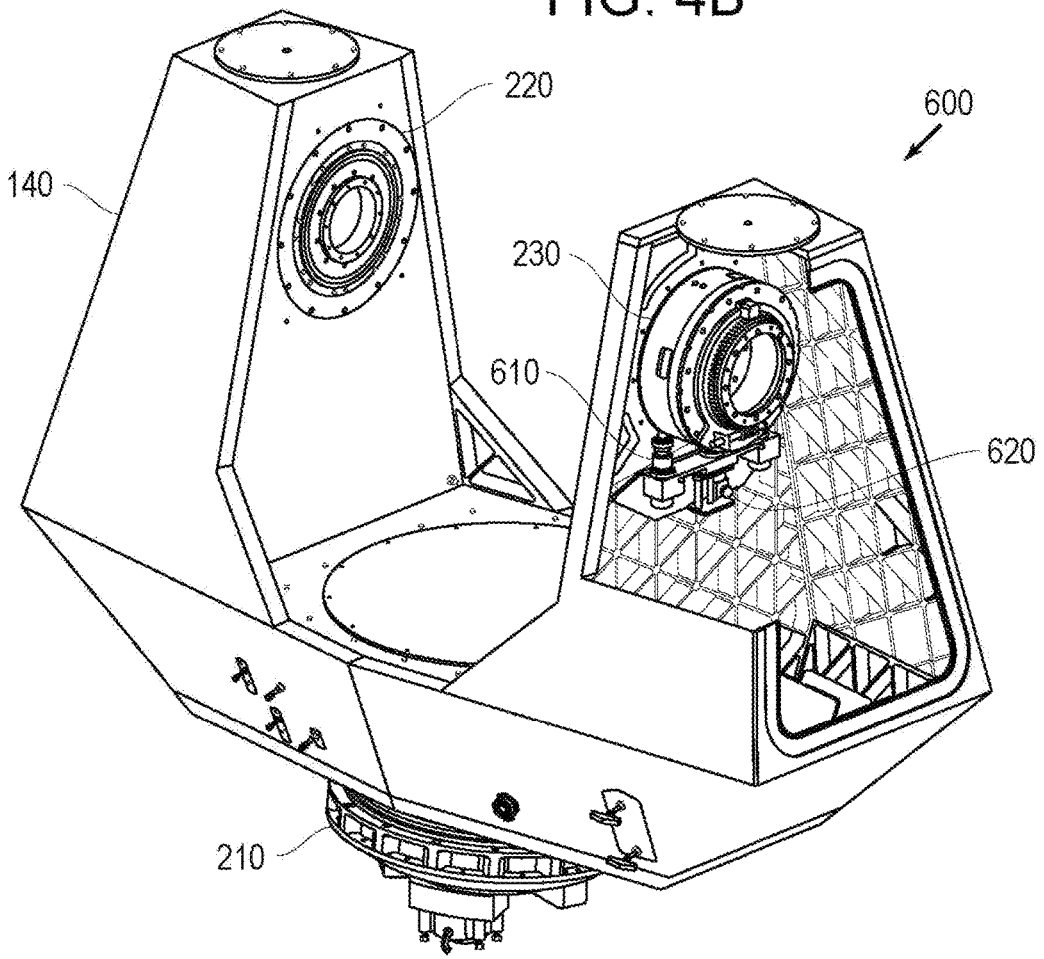
FIGS. 6A and 6B are isometric cutaway and elevation views of the yoke showing an elevation support trunnion.
Figure 6B:
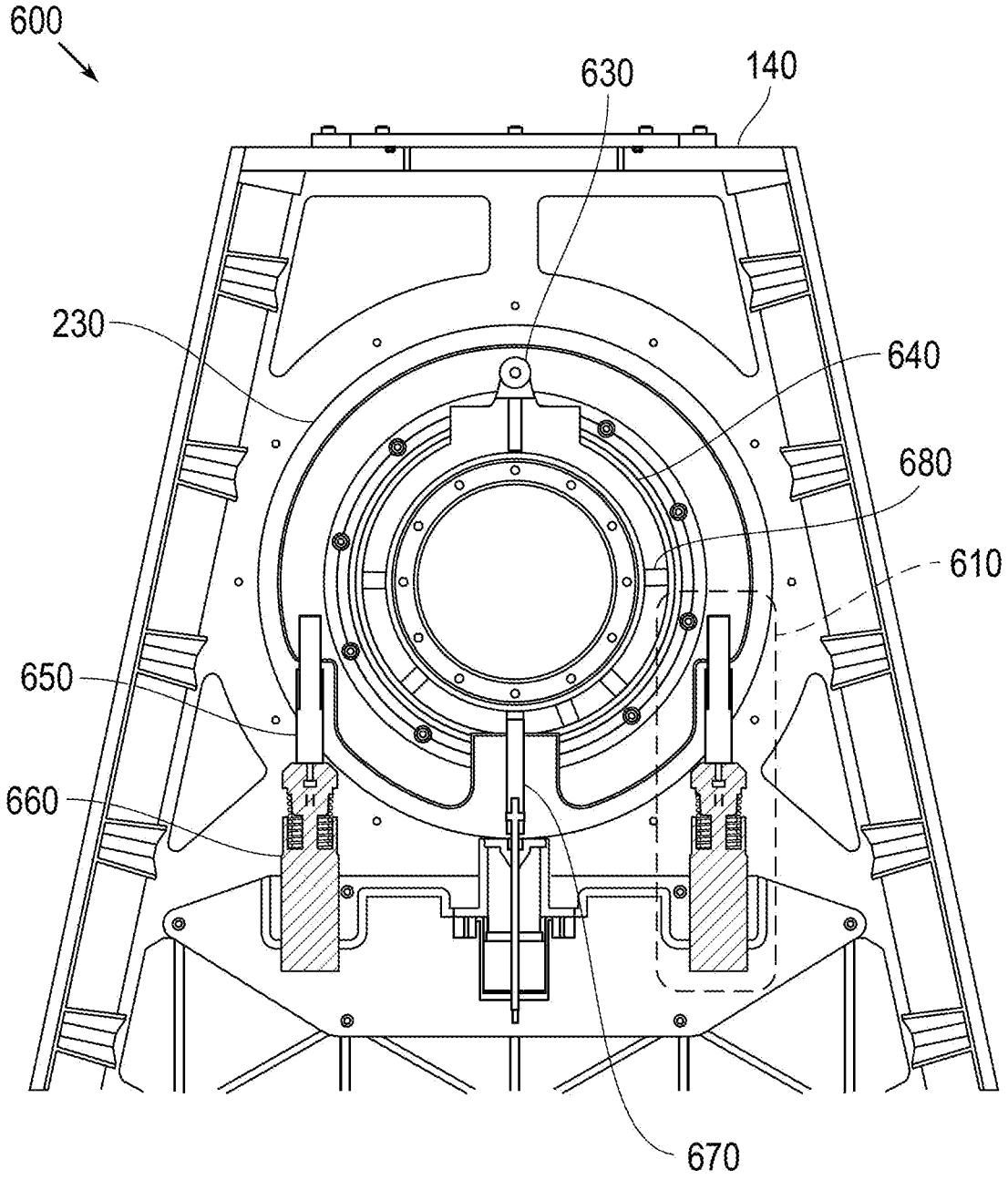

FIGS. 6A and 6B illustrate respective isometric cutaway and elevation views 600 of the yoke 140 with the elevation support trunnion therein. The trunnion 230 is a self-contained modular unit that can be replaced for customized operations for sundry payloads 150. A pair of buffers 610 flank a stow pin actuator 620 underneath the trunnion 230. Unlike the drive trunnion 220, the support trunnion 230 lacks a servo motor.

A roller subassembly 630 is fixed to the support trunnion shaft 640 and rotates through an arc as the payload 150 pivots in elevation. The buffers 610 each includes a push rod 650 and a dampener 660. In the event of an over-travel fault, the roller 630 acts on either of the push rods 650. The rods 650 act on the dampener 660, which bring the payload 150 to a gentle stop.

The internally mounted elevation stow pin 670 interfaces with stow pin holes 680 in the annular shaft 640. The stow pin 670 can be remotely activated with the stow pin actuator 620 to either prevent rotation or permit rotation of the elevation axis. The elevation support trunnion 230 supports the payload 150 and provides ancillary functions for the elevation axis. Principally, the elevation support trunnion 230 operates in conjunction with a pair of buffers 610 to provide over-travel protection—sometimes called "hard stop"—to the payload 150.

Figure 7:
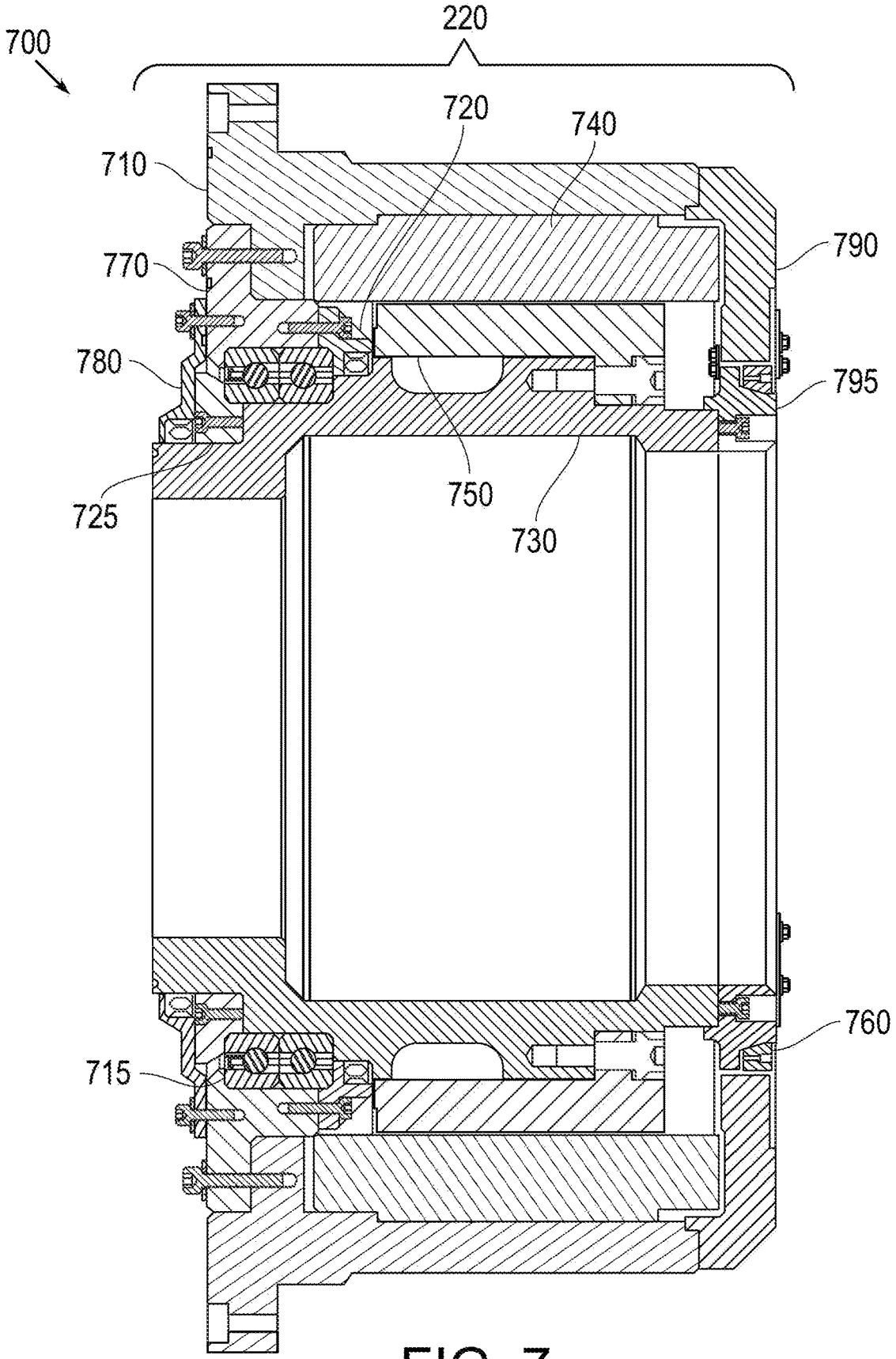
FIG. 7 is a cross-section elevation view of an elevation drive trunnion.

FIG. 7 illustrates an elevation cross-section view 700 of the elevation drive trunnion 220. Left-to-right proceeds from fore to aft (as viewed from the corresponding arm of the yoke 140). An annular outer housing 710 contains an outer bearing housing 770, a duplex pair of bearings 715, outer and inner bearing clamp rings 725 and 720, an annular shaft 730, a stator 740 and a rotor 750 for a servo motor.

A sealing cap 780 attaches to the outer bearing housing 770 and covers the outer bearing clamp ring 725. An outer aft ring 790 provides closure to the assembly. An encoder ring mount 795 is attached to end of shaft 730 and provides a mounting interface for encoder ring 760. Note that the shaft 730, outer clamp ring 725, rotor 750, encoder ring mount 795, and encoder ring 760 rotate together within the stator 740 contained in the housing 710. The shaft 730 includes a large through-bore for cable passage or a Coudé path.

The outer bearing housing 770 provides the bearing seat. An alternative method of manufacture can combine housings 770 and 710 into a single unit. However, the embodiment shown enables these housings to be composed of separate materials, which can facilitate thermal dissipation. The outer aft ring 790 provides end closure of the assembly and interface for an encoder sensor set 840 (see FIG. 8), which measures rotation angle of shaft by optically sensing special markings on the outer surface of the encoder ring 795.

Figure 8:
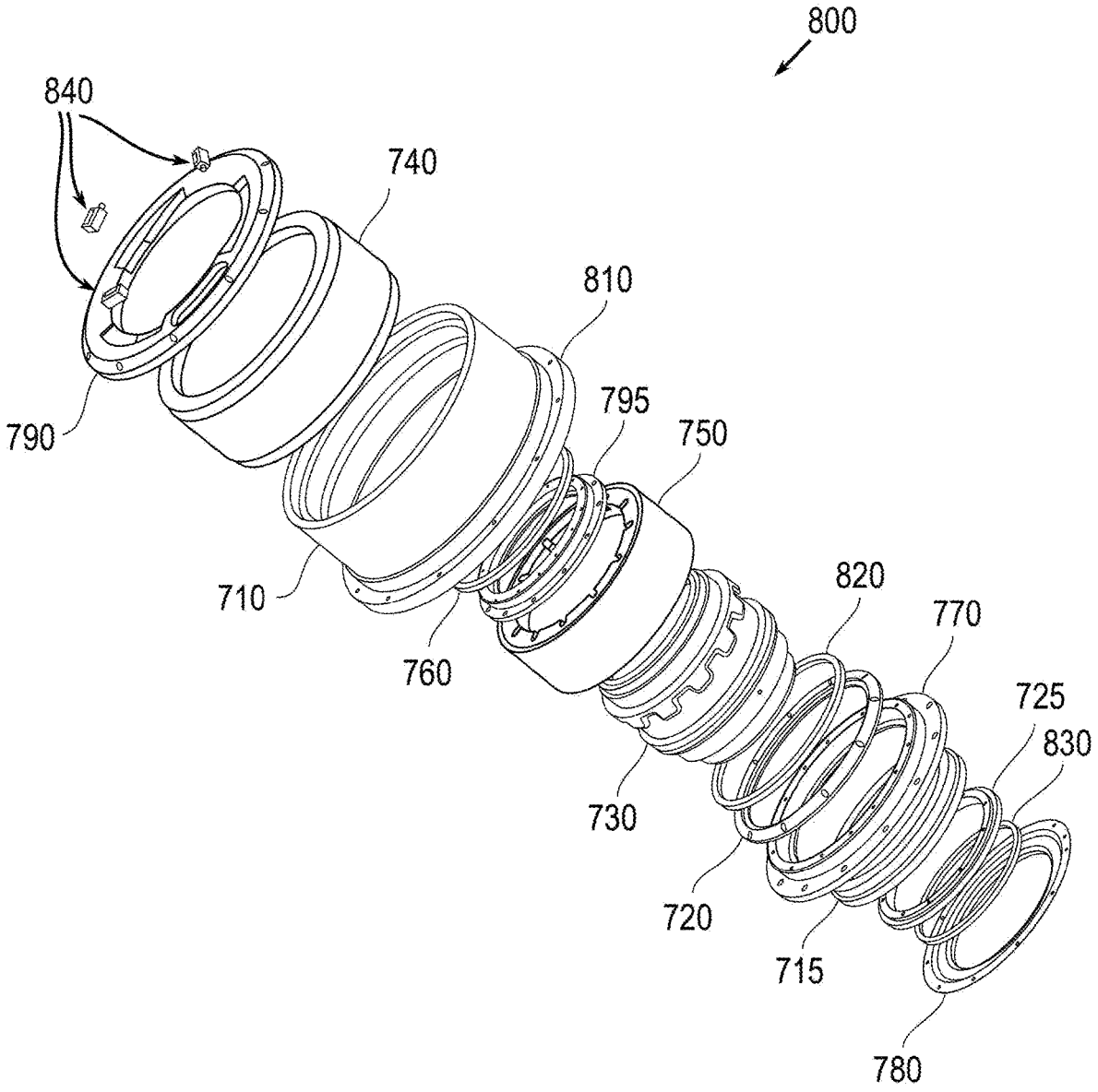
FIG. 8 is a perspective exploded view of components for the elevation drive trunnion.

FIG. 8 illustrates an isometric exploded view 800 of components for the elevation drive trunnion 220. Top right-to-bottom left features the components from aft to fore. The housing 710 includes a radially extending circumferential rim 810 from which the trunnion 220 mounts to the yoke 140. Also included are dynamic seals 820 and 830, as well as an encoder sensor set 840. From left-to-right, the components are shown as encoder sensors 840, outer aft ring 790, stator 740, housing 710, encoder ring 760, encoder ring mount 795, rotor 750, shaft 730, dynamic seal 820, inner clamp ring 720, outer bearing housing 770, bearings 715, outer clamp ring 725, dynamic seal 830 and sealing cap 780. These components insert into the housing 710 in approximately this sequence. The sealing cap 780, has mounting provisions for the dynamic seal 830, which prevents contaminants from entering the bearings 715.

Figure 9:
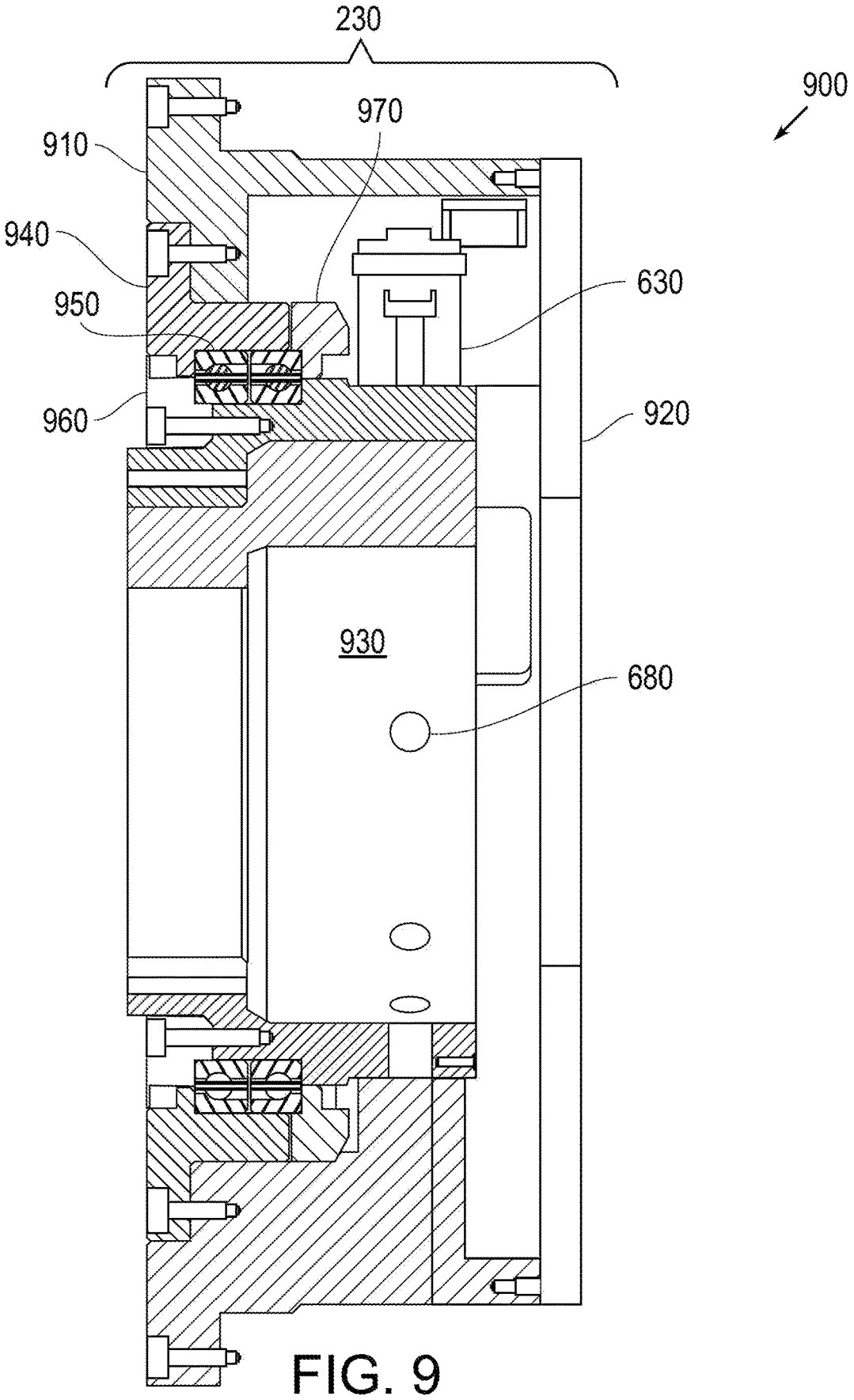
FIG. 9 is an elevation view of the elevation support trunnion.

FIG. 9 illustrates an elevation view 900 of components for the elevation support trunnion 230. Left-to-right proceeds from aft to fore (as viewed from the corresponding arm of the yoke 140). An annular housing 910 surrounds and has mounting provisions for a bearing housing 940. An end plate 920 is attached to housing 910, and has a large through bore for cable passage. An annular shaft 930 has a mounting provision for the payload 150, and turns in response to rotational motion from the drive trunnion 220. A roller subassembly 630 is attached to outer diameter of shaft 930.

The bearing housing 940 contains a duplex bearing pair 950 that separates the bearing housing 940 from both the shaft 930 and an outer bearing clamp ring 960. The bearing housing 940 also has a mounting interface for a dynamic seal 1040, which contacts the outer bearing clamp ring 960 and prevents contaminants from entering bearing pair 950. An inner bearing clamp ring 970 clamps the bearing pair 950 to the bearing housing 940 and also has a mounting interface for a dynamic seal 1030. The dynamic seal 1030 contacts the outer surface of the shaft 930 and prevents contaminants from entering bearing pair 950. The shaft 930 includes cavities 680 disposed around its circumference to receive the stow pin 670.

Figure 10A:
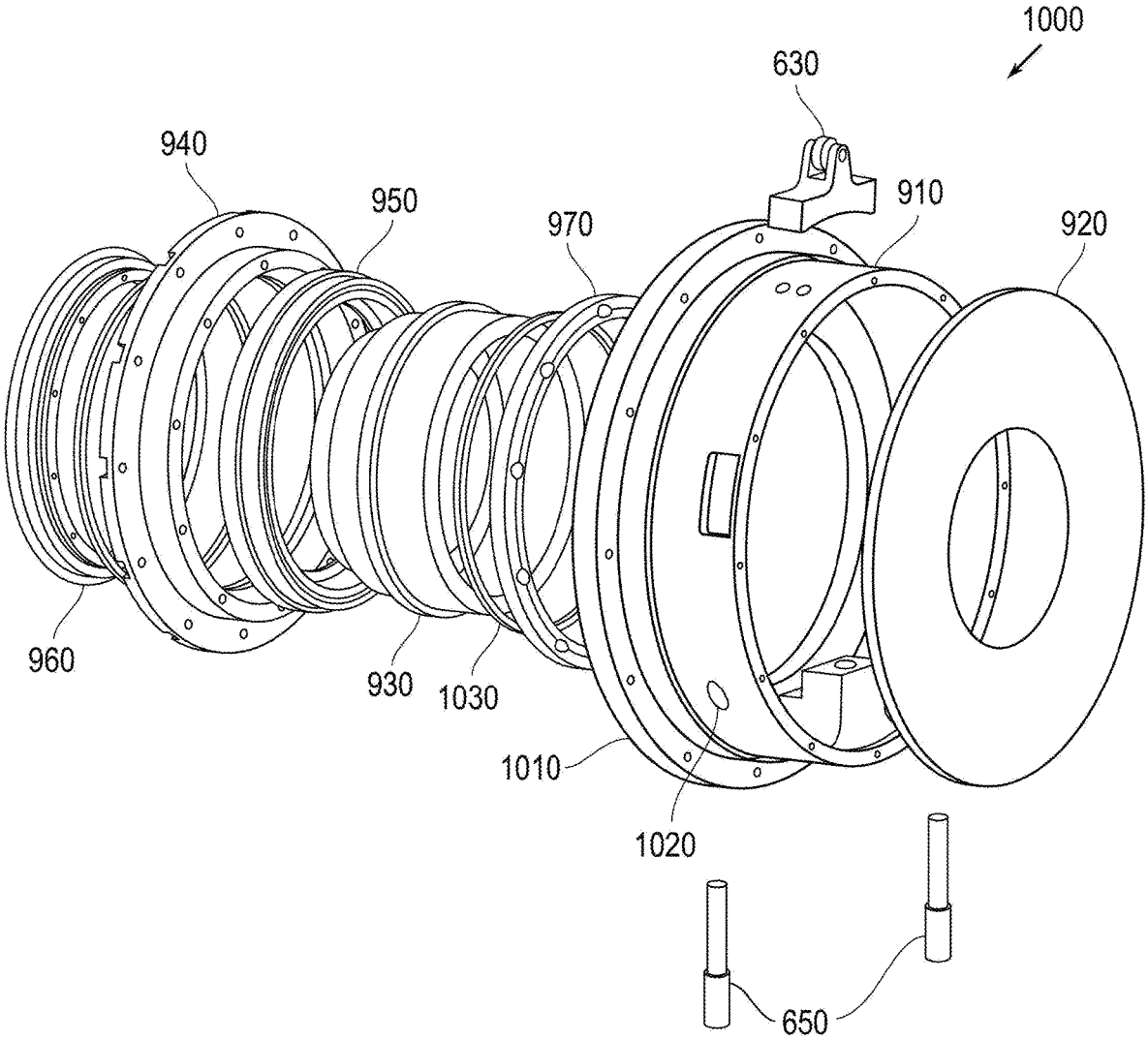
FIGS. 10A and 10B are isometric exploded views of components for the elevation support trunnion.
Figure 10B:
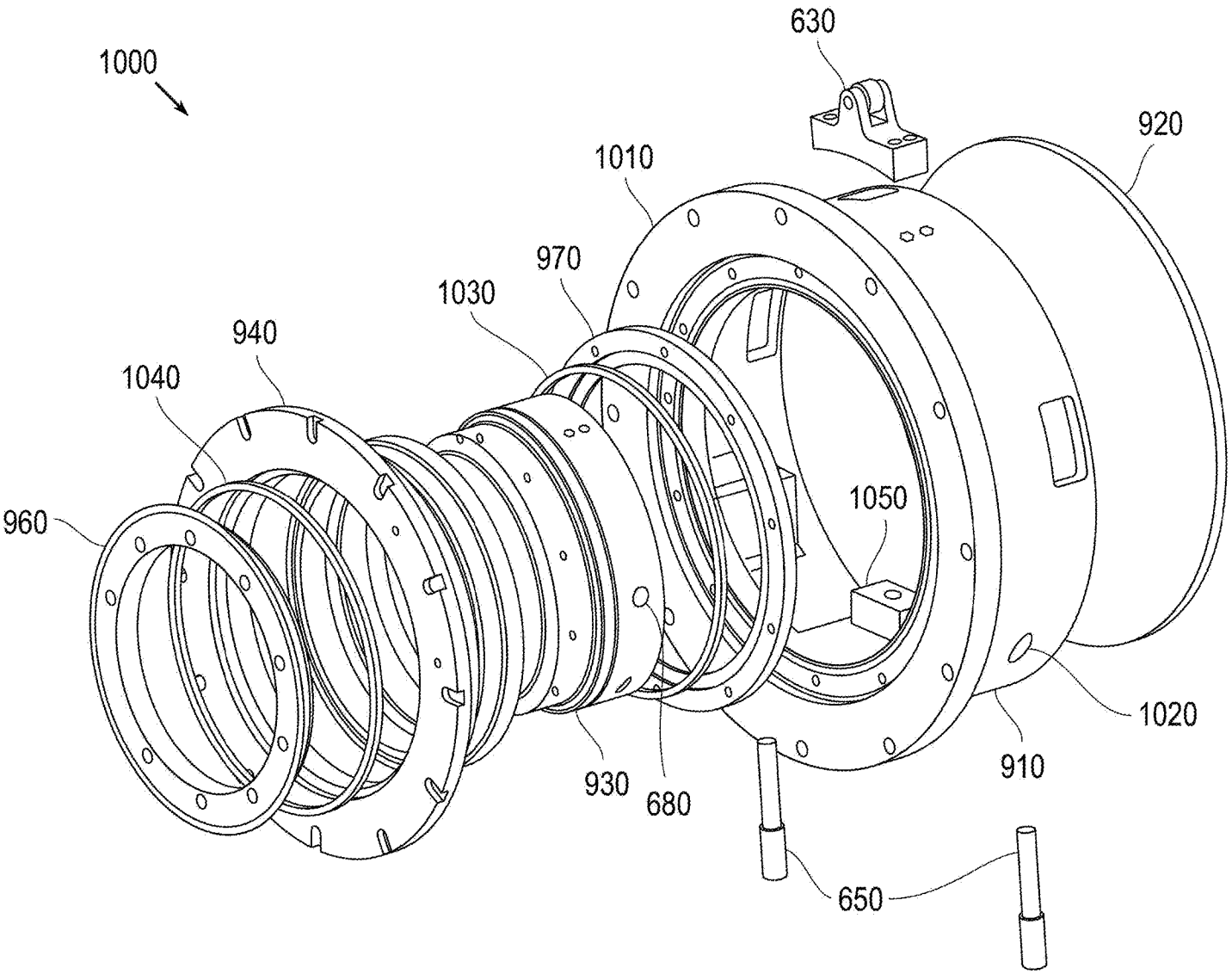

FIGS. 10A and 10B illustrate perspective exploded views 1000 of the elevation support trunnion 230. The annular housing 910 incorporates a radially extending circumferential rim 1010 from which the trunnion 230 mounts to the yoke 140. The axial peripheries of the housing 910 feature a plurality of cavities 1020 and an inward protruding block 1050. The push rods 650 slide in cavities 1020 in the annular housing 910. In the event that the payload 150 rotates outside of a normal operational range, the shaft 930 will also rotate and cause the roller subassembly 630 to come into contact with one of the push rods 650. As the push rods 650 slide in cavities 1020, they compress the dampener 660, which brings the payload to a gentle stop (see FIG. 6B).

Views 1000 feature components left-to-right proceeding from aft to forward (as with view 900). These are identified as outer bearing clamp ring 960, dynamic seal 1040, bearing housing 940, duplex bearing pair 950, annular shaft 930, dynamic seal 1030, inner bearing clamp ring 970, annular housing 910, push rods 650 and end plate 920. The bearing housing 940 provides a bearing seat, and mounts to the annular housing 910. An alternative process for manufacture can combine housings 940 and 910 into a single unit. Nonetheless, the embodiment shown enables these to be composed of separate materials, which facilitates thermal dissipation.

The elevation cross-section view 900 and exploded isometric views 1000 illustrate details of the elevation support trunnion 230. The annular housing 910 contains the bearing housing 940, duplex bearing pair 950, outer and inner bearing clamp rings 960 and 970, annular shaft 930, roller subassembly 630, end plate 920 and dynamic seals 1030 and 1040. The shaft 930 includes a large through-bore for cable passage or a Coudé path.

The annular shaft 930 rotates within the bearing housing 940 by means of the duplex bearing pair 950. The outer bearing clamp ring 960 secures the shaft 930 to the duplex bearing pair 950, whereas the inner bearing clamp ring 970 secures the duplex bearing pair 950 to the bearing housing 940.

The gimbal assembly 110 is responsible for aiming the payload 150 at the target. The main structural element of the gimbal is the yoke 140 with an external faceted shape designed to reduce radar observability of the assembly 110. Application specific ancillary equipment (not shown) can be mounted within the yoke 140, and generally may include cables, hoses, electronics, heating, ventilation and air conditioning (HVAC) systems, and optics.

The pedestal 120 interfaces the azimuth drive assembly 210 to the host ship's foundation. Like the yoke 140, the pedestal 120 is designed to be stiff and to have a faceted exterior. Additionally the pedestal 120 tilts, which orients the azimuthal axis of the assembly 210 rearwards. The assembly 110 is intended to be installed on a combat ship, so that this results in the azimuthal axis being oriented towards ships structures, outside of the desired field of regard. Designs for non-vertical mounting are known in observatories where the telescope may rotate about a tilted axis.

A number of advantages are afforded by exemplary embodiments. The purposeful shaping of the gimbal assembly 110 reduces the radar observability, which rendering the hosting ship more difficult to detect. This shaping as an inherent feature of the structure reduces weight and complexity, as compared to a supplemental external fairing, as well as reducing the need for radar-absorbing materials and avoiding fragility and hassle of external shells.

The large internal voids are used for the housing of gimbal and payload ancillary equipment, as well as cables and hoses. These items would otherwise have to be mounted externally where they would be subject to the seaspray environment. Routing of external cables, hoses, and fiber optic cables also impacts the radar cross section. Such external routings would be susceptible to damage from wave action.

The azimuth drive assembly 210 has multiple design features advantageous to gimbal performance. The inner and outer bearing housings are stainless steel, which has a coefficient of thermal expansion (CTE) similar to the CTE of the duplex bearing pair, which ensures nearly uniform bearing friction over a large operating temperature range. Consistent performance over a large temperature range is critical for applications in which the gimbal is fielded on naval platforms. Bearing friction uniformity has a direct correlation to gimbal control system accuracy.

The exemplary design of the azimuth drive assembly 210 enables a large bearing pair diameter, such as 0.6 m, and a short overall assembly height, such as 0.16 m. To optimize gimbal control system performance, friction should be minimized and stiffness maximized during gimbal motion. This azimuth drive assembly 210 incorporates the duplex bearing pair 415, which provides a high stiffness to friction ratio.

Both the elevation drive and support trunnions 220 and 230 have multiple design features advantageous to gimbal performance. The annular shafts 730 and 930 and bearing housings 770 and 940 are stainless steel, which have a coefficient of thermal expansion (CTE) similar to the CTE of the face-to-face duplex bearing pairs 715 and 950, which ensures nearly uniform bearing friction over a large operating temperature range. The duplex bearing pair arrangement 715 and 950 on both elevation trunnions 220 and 230 was selected to minimize rotational friction, as this arrangement is forgiving of bearing moment loading induced by mounting misalignment of the payload 150.

The over-travel protection system is located within the skin of the yoke 140 and is protected from the elements. This also prevents interference with the payload 150, and enables any crash loads to be transmitted though the trunnion interface. The trunnion-to-payload interface is necessarily robust, so using this load path avoids additional hardening elsewhere on the payload skin. Using a roller subassembly 630 and pushrod 650 arrangement enables the buffers 610 themselves to be reoriented into a convenient mounting orientation within the structure of the yoke 140.

The operation of a tilted azimuth axis is advantageous for a naval laser system because of the need to maintain track on objects directly over the ship. In any two-axis gimbal, a phenomenon known as "gimbal lock" occurs when the line-of-sight is parallel to the azimuth axis. As the target elevation increases, the azimuth rates required to maintain track increase dramatically, until eventually the singularity is reached. By reorienting this problem area out from above the ship, reasonable tracking rates and gimbal controllability are maintained overhead.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A gimbal trunnion for pivoting a payload along an axis, said trunnion comprising:

an annular shaft for turning the payload along the axis;

an annular rotor extending radially outward from said shaft for turning said shaft;

an annular stator extending radially outward from said rotor for rotationally driving said rotor;

an annular housing extending radially outward from said stator for mounting said trunnion to the payload and encasing a bearing housing;

a duplex pair of bearings to provide rotational interface between said shaft and said bearing housing; and inner and outer bearing clamp rings to secure said duplex pair of bearing to said shaft and said bearing housing.

2. The trunnion according to claim 1, further including an encoder ring mount attaching to the said shaft, which provides a mounting interface for an encoder ring.

3. The trunnion according to claim 2, further including an encoder sensor set, which measures rotation angle of said shaft by optically sensing markings on outer surface of said encoder ring.

4. The trunnion according to claim 2, further including a brake rotor axially opposite the payload, and a rotor standoff separating said brake rotor and said shaft.

5. The trunnion according to claim 4, further including:

a caliper mount attaching to said encoder ring mount, and a brake caliper for engaging said brake rotor, said brake caliper attaching to said caliper mount.

6. The trunnion according to claim 3, further including a stow pin actuator radially adjacent from said housing.

7. The trunnion according to claim 1, further including a buffer having a dampener and a push rod.

* * * * *